US008760484B2

(12) United States Patent
Ohnishi

(10) Patent No.: US 8,760,484 B2
(45) Date of Patent: Jun. 24, 2014

(54) ATTACHMENT MECHANISM OF OPTICAL SCANNER AND IMAGE FORMING APPARATUS

(71) Applicant: Kyocera Document Solutions Inc., Osaka (JP)

(72) Inventor: Masato Ohnishi, Osaka (JP)

(73) Assignee: KYOCERA Document Solutions Inc., Kyoto (JP)

( * ) Notice: Subject to any disclaimer, the term of this patent is extended or adjusted under 35 U.S.C. 154(b) by 0 days.

(21) Appl. No.: 13/899,390

(22) Filed: May 21, 2013

(65) Prior Publication Data

US 2013/0314485 A1 Nov. 28, 2013

(30) Foreign Application Priority Data

May 24, 2012 (JP) ..... 2012-118484

(51) Int. Cl.
*B41J 15/14* (2006.01)
*B41J 27/00* (2006.01)

(52) U.S. Cl.
USPC ..... 347/242; 347/257

(58) Field of Classification Search
USPC ..... 347/224, 242, 257, 263; 220/213, 253, 220/259.4, 669, 672, 674; 399/13, 110, 399/113, 117, 119, 167
See application file for complete search history.

(56) References Cited

U.S. PATENT DOCUMENTS

| | | | | |
|---|---|---|---|---|
| 3,874,752 | A * | 4/1975 | Imazaike | 384/296 |
| 8,280,278 | B2 * | 10/2012 | Ueno et al. | 399/111 |
| 8,520,049 | B2 * | 8/2013 | Takahashi et al. | 347/263 |
| 2009/0080937 | A1 | 3/2009 | Kita et al. | |
| 2011/0242265 | A1 | 10/2011 | Takahashi et al. | |

FOREIGN PATENT DOCUMENTS

| | | | |
|---|---|---|---|
| JP | 11-194281 | A | 7/1999 |
| JP | 11-334174 | A | 12/1999 |

* cited by examiner

*Primary Examiner* — Hai C Pham
(74) *Attorney, Agent, or Firm* — Studebaker & Brackett PC

(57) ABSTRACT

An attachment mechanism of an optical scanner includes a supporting structure with an opening and a fixing member. The fixing member positions and fixes the optical scanner with a positioning boss held by the opening. The fixing member includes an annular part having an outer circumference face fitted in the opening and an internal circumference face fitted on the positioning boss. One of the internal circumference face and an outer circumference face of the positioning boss includes a projection and another includes a depression for insertion of the projection. A top face of the projection and/or a bottom face of the depression slope(s) slanted from the circumference. By inserting the positioning boss in the opening, fitting the annular part in the opening, and turning the fixing member to narrow a gap between the top face and bottom face, the optical scanner is fixed to the supporting structure.

12 Claims, 10 Drawing Sheets

Related Art

Related Art

Related Art

Related Art

ATTACHMENT MECHANISM OF OPTICAL SCANNER AND IMAGE FORMING APPARATUS

INCORPORATION BY REFERENCE

This application is based on and claims the benefit of priority from Japanese Patent application No. 2012-118484 filed on May 24, 2012, the entire contents of which are incorporated herein by reference.

BACKGROUND

The present disclosure relates to an attachment mechanism of an optical scanner in an image forming apparatus, such as a copying machine, a printer or a multifunction machine, and the image forming apparatus.

An image forming apparatus typified by a copying machine, a printer or a multifunction machine is provided with a unit structure. In the unit structure, to a frame as a supporting structure arranged inside the image forming apparatus, a laser scanning unit (LSU) as an optical scanner is positioned and fixed.

As positioning and fixing parts of the LSU to the frame, for example, as shown in FIG. 9, it is well-known that an image forming apparatus is configured to fix LSUs 40 arranged for respective colors of four types of toners (developers) to a rectangular-liked frame 42 by fixing members 41. In detail, as shown in FIG. 10, on one side face of each LSU 40 in a longitudinal direction, a pair of positioning bosses 43 with round-shaped sections are formed. In the frame 42, openings 44 (refer to FIG. 11) capable of insertion of the positioning bosses 43 are formed. Moreover, the fixing member 41 is formed in a horizontally long rectangular plate-liked shape and, in an upper part of the fixing member 41, a pair of annular parts 45*a* and 45*b* are formed side by side.

In a lower part of one annular part 45*a*, as shown in FIG. 11, a back extending part 46 extending backward is formed and an outer circumference face of the back extending part 46 is configured to be capable of fitting to an internal circumference face of the opening 44. In addition, on internal circumference faces of both annular parts 45*a* and 45*b*, a plurality of ribs 47 projected slightly inward are formed and the ribs 47 are configured to be capable of fitting to outer circumference faces of the positioning bosses 43. On a back face of the fixing member 41, a projection 48 is provided outside and adjacent to the other annular part 45*b* and configured to capable of fixing a penetrating hole 49 correspondingly bored adjacent to the opening 44 of the frame 42.

Under such a configuration, in a situation of holding the positioning bosses 43 of the LSUs 40 by the openings 44 of the frame 42, the projection 48 is inserted in the penetrating hole 49 and the annular parts 45*a* and 45*b* are inserted between the positioning bosses 43 and the openings 44. Then, the outer circumference face of the back extending part 46 is fitted to the internal circumference face of the opening 44 and the ribs 47 are fitted to the outer circumference faces of the positioning bosses 43. Thus, after the positioning bosses 43 and annular parts 45 are positioned, the LSUs 40 are fixed to the frame 42 by screws 50 and a header pin 51 (refer to FIG. 10).

However, in the above-mentioned positioning and fixing parts, as shown in FIG. 12, transverse sections of respective opposite faces of the rib 47 and positioning boss 43 are formed in a straight line-liked shape. Therefore, when accuracy of these dimensions becomes uneven, a groove between these is caused to increase backlash in the attachment.

Thereby, it is fear that accuracy of positioning the LSU is decreased and that, under the influence of oscillation, an image error is caused.

In addition, as other positioning and fixing parts for the LSU, another image forming apparatus is configured, when the LSU is located on an active position, to put a pair of left and right positioning axes in contact with positioning grooves of left and right side plates and to put a supporting projection in contact with a rear sideplate. Subsequently, in a situation of putting the LSU in non-contact with a rotating axis, the LSU is supported to an apparatus main body. In a further image forming apparatus, the LSUs are located side by side between a front side plate and the rear side plate and partitioned by a stay fixed between the front side plate and rear side plate. Moreover, an attachment member is attached between the side plates and the stay is also fixed to the attachment member. Subsequently, the attachment member is rotated in a situation of being applied to a stopper, thereby bringing the positioning of the attachment member.

However, in these techniques, it is fear that accuracy of dimensions of components becomes uneven to decrease accuracy of positioning the LSU.

Moreover, in a furthermore image forming apparatus, after a position adjusting part adjusts a positioning gap of an LSU attached to a block, the block with the positioning adjusted LSU is installed to a frame.

However, this technique requires labor and equipment for the positioning in separate process from the attachment.

SUMMARY

In accordance with an embodiment of the present disclosure, an attachment mechanism of an optical scanner includes a supporting structure and a fixing member. In the supporting structure, an opening is formed. The fixing member is configured to position and fix the optical scanner in which a positioning boss held by the opening is formed. The fixing member also includes an annular part having an outer circumference face capable of fitting in the opening and an internal circumference face capable of fitting on the positioning boss. One of the internal circumference face of the annular part and an outer circumference face of the positioning boss includes a projection and another includes a depression capable of insertion of the projection. At least one of a top face of the projection and a bottom face of the depression slopes to one side on the circumference of the annular part and positioning boss. In a situation of inserting the positioning boss in the opening, by fitting the annular part in the opening and by turning the fixing member in a direction of narrowing a gap between the top face of the projection and bottom face of the depression, the optical scanner is fixed to the supporting structure.

In accordance with an embodiment of the present disclosure, an image forming apparatus includes an attachment mechanism of an optical scanner. The attachment mechanism includes a supporting structure and a fixing member. In the supporting structure, an opening is formed. The fixing member is configured to position and fix the optical scanner in which a positioning boss held by the opening is formed. The fixing member also includes an annular part having an outer circumference face capable of fitting in the opening and an internal circumference face capable of fitting on the positioning boss. One of the internal circumference face of the annular part and an outer circumference face of the positioning boss includes a projection and another includes a depression capable of insertion of the projection. At least one of a top face of the projection and a bottom face of the depression slopes to one side on the circumference of the annular part and positioning boss. In a situation of inserting the positioning boss in the opening, by fitting the annular part in the opening and by turning the fixing member in a direction of narrowing a gap between the top face of the projection and bottom face of the depression, the optical scanner is fixed to the supporting structure.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
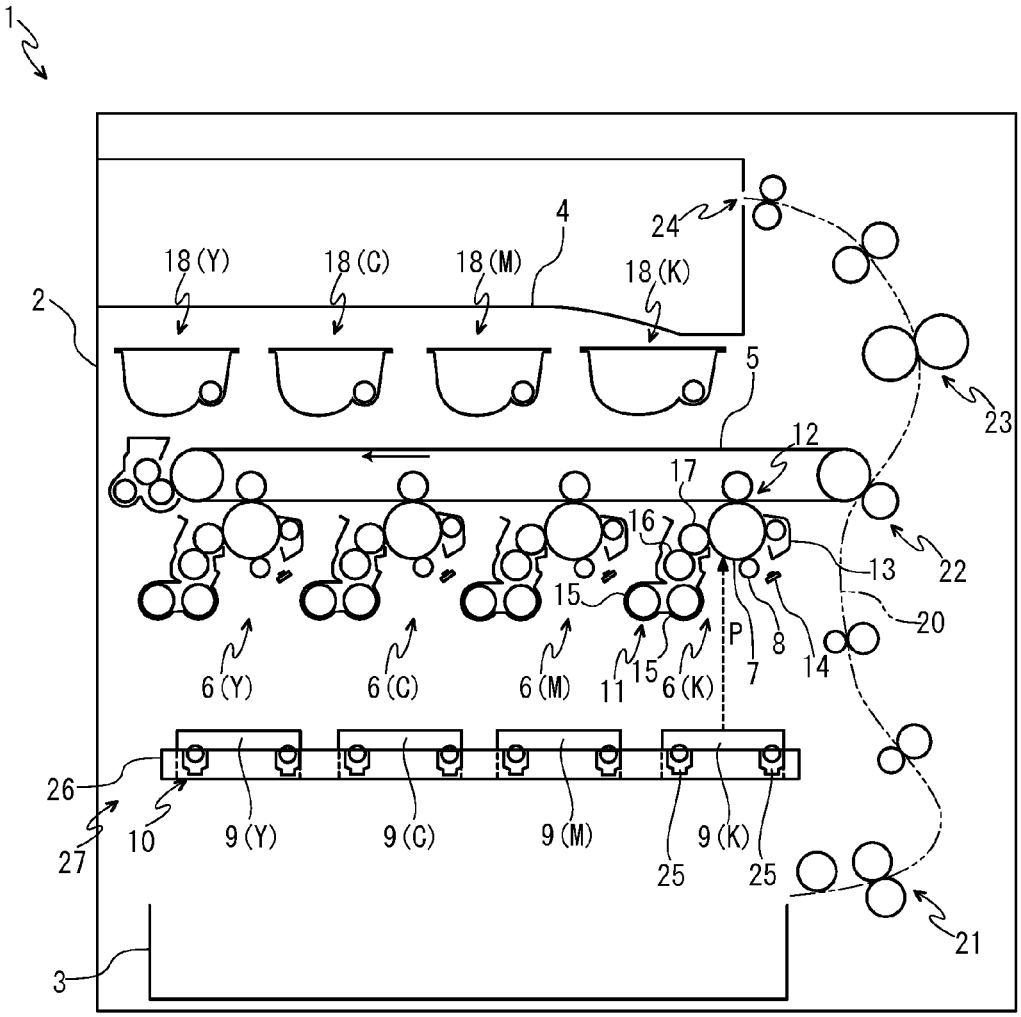
FIG. 1 is a schematic diagram schematically showing an image forming apparatus according to an embodiment of the present disclosure.

First, with reference to FIG. 1, the entire structure of a color printer 1 as an image forming apparatus will be described, which is provided with a unit structure 27 as an attachment mechanism having a laser scanning unit (LSU) 9 as an optical scanner fixed to a frame 26. Hereinafter, it conveniently will be described so that the front side of each component is positioned at the front-hand side of FIG. 1. FIG. 1 is a schematic diagram schematically showing the color printer according to an embodiment of the present disclosure. The reference characters "Y", "C", "M" and "K" appeared suitably in the specification and figure indicate colors of yellow, cyan, magenta and black.

The color printer 1 includes a box-formed case 2. In a lower part of the case 2, a sheet feeding cartridge 3 configured to store sheets for transferring (not shown) is installed and, in an upper part of the case 2, an ejected sheet tray 4 is formed.

In the upper part of the case 2, an intermediate transferring belt 5 as an image carrier is bridged over a plurality of rollers. Below the intermediate transferring belt 5, an exposure device 10 is installed. The exposure device 10 consists of four laser scanning units (LSU) 9(Y), 9(C), 9(M) and 9(K) (hereinafter, collectively indicated by "LSU 9") arranged for respective colors of toners (developers). Along a lower part of the intermediate transferring belt 5, four image forming units 6(Y), 6(C), 6(M) and 6(K) (hereinafter, collectively indicated by "image forming unit 6") are installed for respective colors of toners.

One of the four image forming units will be described. In each image forming unit 6, a photosensitive drum 7 is rotatably attached. Around the photosensitive drum 7, a charger 8, a development device 11, a first transferring unit 12, a cleaning device 13 and a static eliminator 14 are located.

In a lower part of the development device 11, a pair of stirring rollers 15 are installed, diagonally above of the stirring rollers 15, a magnetic roller 16 is installed and, diagonally above of the magnetic roller 16, a developing roller 17 is installed. Above the development device 11, four containers 18(Y), 18(C), 18(M) and 18(K) (hereinafter, collectively indicated by "container 18") as toner cases corresponding to the image forming units 6 are installed for respective colors of the toners.

At one side (the right-hand side of the figure) in the case 2, a sheet conveying path 20 of the sheet is arranged. At an upper stream end of the conveying path 20, a sheet feeder 21 is positioned. At an intermediate stream part of the conveying path 20, a second transferring unit 22 is positioned in contact with one end (a right end of the figure) of the intermediate transferring belt 5. At a lower stream part of the conveying path 20, a fixing unit 23 is positioned and, at a lower stream end of the conveying path 20, an ejection opening 24 is positioned.

Next, the operation of forming an image by the color printer 1 having such a configuration will be described. When the power is supplied to the color printer 1, various parameters are initialized and initial determination, such as temperature determination of the fixing unit 23, is carried out. Subsequently, in the color printer 1, when image data is inputted and a printing start is directed from a computer or the like connected with the color printer 1, image forming operation is carried out as follows.

First, the surface of the photosensitive drum 7 is electrically charged by the charger 8. Then, exposure corresponding to the image data on the photosensitive drum 7 is carried out by a laser (refer to arrow P) from the exposure device 10, thereby forming an electrostatic latent image on the surface of the photosensitive drum 7. The electrostatic latent image is developed to a toner image having a correspondent color with the toner in the development device 11. The toner image is first-transferred onto the surface of the intermediate transferring belt 5 in the first transferring unit 12. The above-mentioned operation is repeated in order by the image forming units 6, thereby forming the toner image having full color onto the intermediate transferring belt 5. Toner and electric charge remained on the photosensitive drum 7 are eliminated by the cleaning device 13 and static eliminator 14.

On the other hand, the sheet fed from the sheet feeding cartridge 3 or a manual bypass tray (not shown) by the sheet feeder 21 is conveyed to the second transferring unit 22 in a suitable timing for the above-mentioned image forming operation. Then, in the second transferring unit 22, the toner image having full color on the intermediate transferring belt 5 is second-transferred onto the sheet. The sheet with the second-transferred toner image is conveyed to a lower stream on the conveying path 20 to enter the fixing unit 23, and then, the toner image is fixed on the sheet in the fixing unit 23. The sheet with the fixed toner image is ejected from the ejection opening 24 onto the ejected sheet tray 4.

Figure 2:
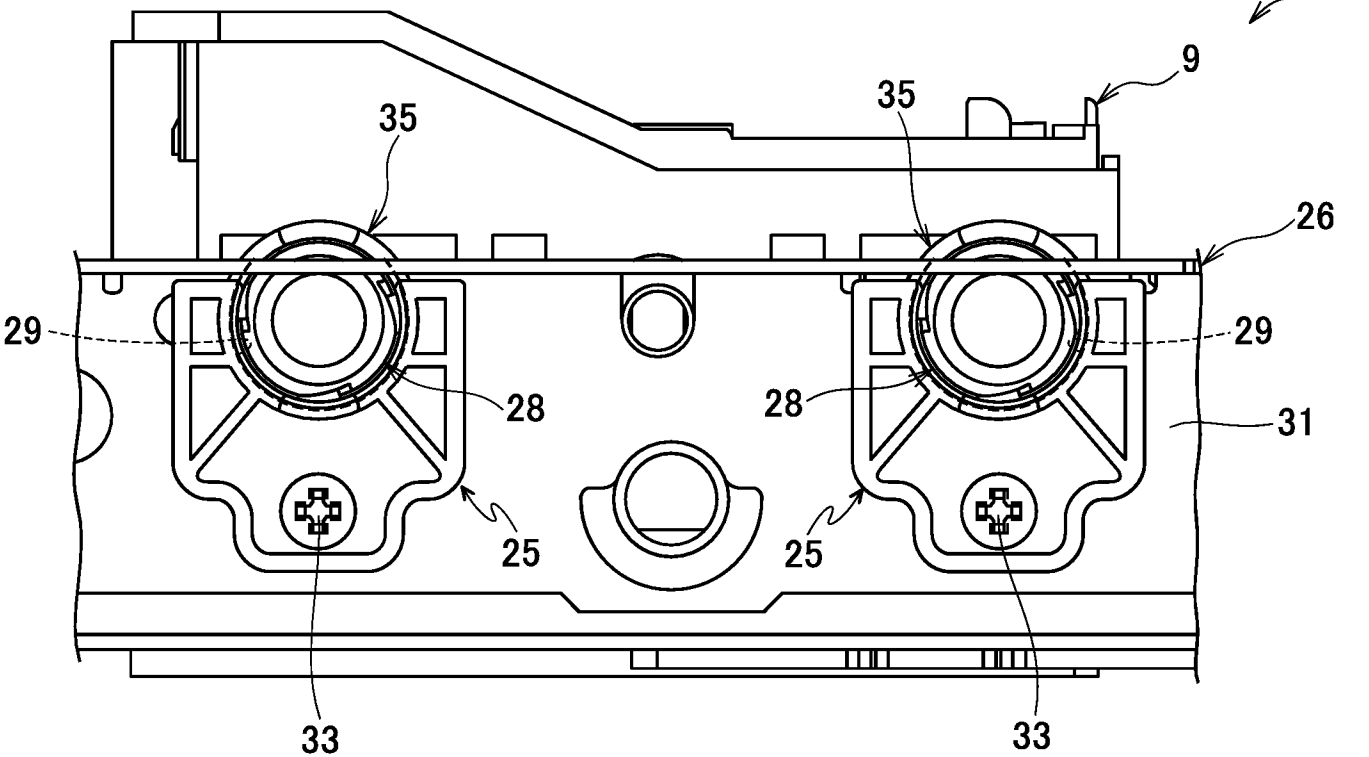
FIG. 2 is an enlarged front view showing a schematic configuration of a unit structure according to the embodiment of the present disclosure.

Next, the unit structure 27 configured to position and fix the above-mentioned LSUs 9 to the frame 26 as a supporting structure by fixing members 25 will be described. As shown in FIGS. 1 and 2, the unit structure 27 includes the four LSUs 9, frame 26 and fixing members 25. In the LSUs 9, positioning bosses 28 are formed. In the frame 26, openings 29 holding the positioning bosses 28 are formed. The fixing members 25 respectively positions and fixes the LSUs 9 to the frame 26.

One of the four LSUs will be described. The LSU 9 is formed in a longitudinal box-liked shape. As shown in FIG. 2, in a front side (one side) of the LSU 9 in the longitudinal direction, a pair of positioning bosses 28 are formed side by side. The positioning bosses 28 are formed in a cylinder-liked shape. On the other hand, in a rear side (another side) of the LSU 9 in the longitudinal direction, other positioning bosses not shown are formed.

On an outer circumference face of the positioning boss 28, as shown in FIGS. 3-6, groove-liked depressions 30 are formed to extend from a top edge of the positioning boss 28 backward. In the embodiment, the depressions 30 are respectively arranged at three positions on the outer circumference face of each positioning boss 28. The depressions 30 are also located at equal intervals in a circumferential direction of each positioning boss 28. A bottom face 30*a* of the depression 30 slopes upward in a clockwise direction in a front view. That is, the depth of the depression 30 gradually shallows in the clockwise direction in the front view.

The frame 26 is attached, as shown in FIG. 1, inside the case 2. This frame 26 is configured, as shown in FIG. 2, in a rectangular frame-liked shape in a planer view by a front side plate 31, a rear side plate, a right side plate and a left side plate (not shown). An upper end and a lower end of the front side plate 31 are bent forward (laterally). In the bending part of the upper end of the front side plate 31, the openings 29 capable of insertion of the positioning bosses 28 are formed in shapes and a positions respectively corresponding to the positioning bosses 28. The opening 29 is formed by a cut-out over the bending part of the front side plate 31. An inside diameter of the opening 29 is determined greater than an outside diameter of the positioning boss 28. On the other hand, in the rear side plate, other openings (not shown) capable of insertion of the other positioning bosses in the rear side of the LSU 9 in the longitudinal direction is formed.

Figure 3:
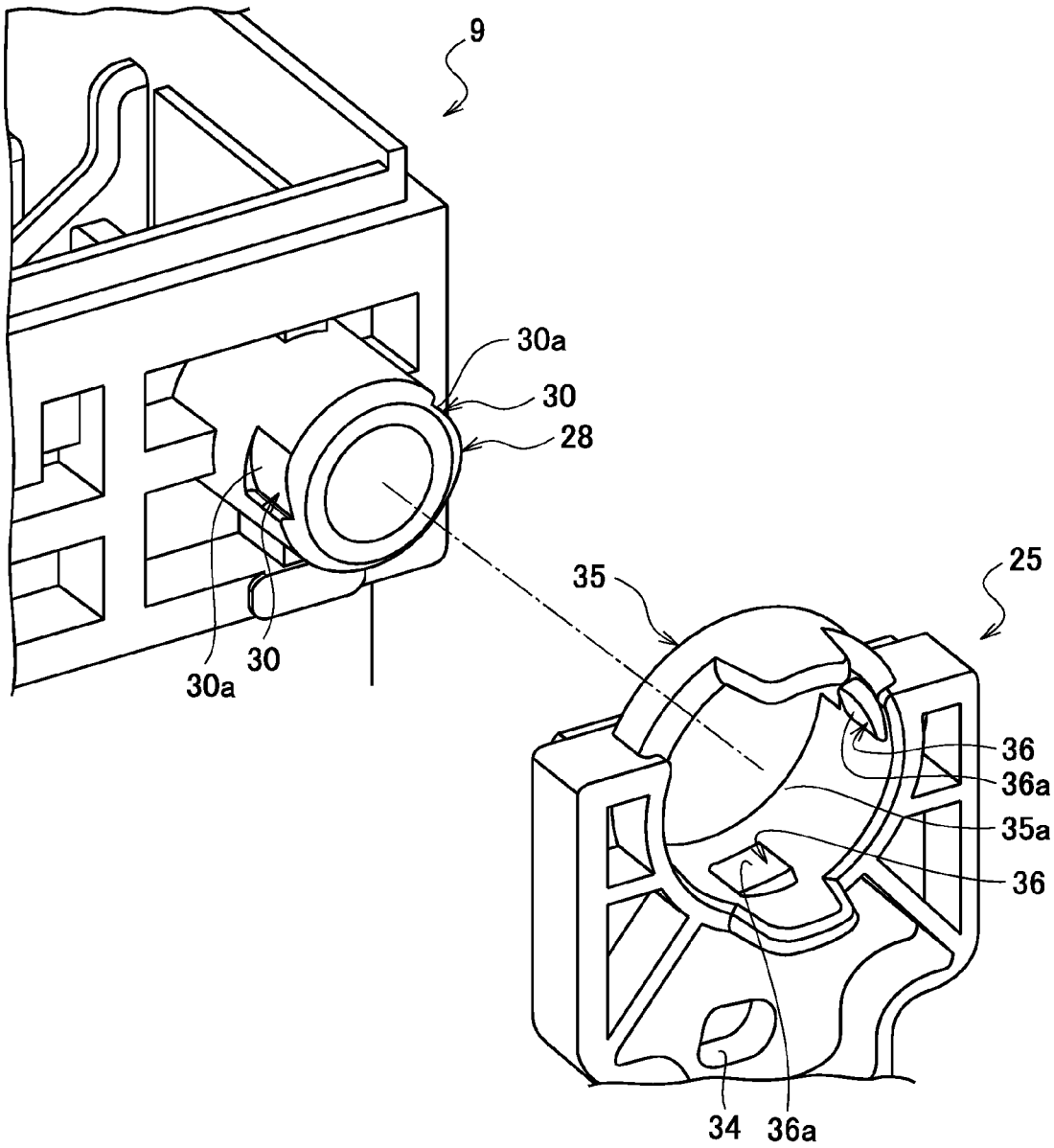
FIG. 3 is a perspective view showing a schematic configuration of a positioning boss and a positioning member of an LSU according to the embodiment of the present disclosure.
Figure 4:
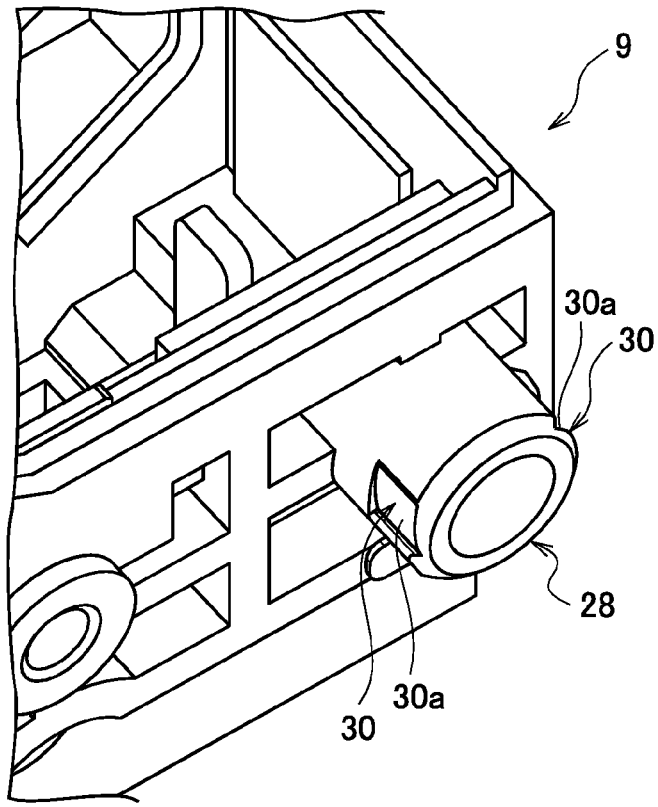
FIG. 4 is a left top perspective view showing the schematic configuration of the positioning boss of the LSU according to the embodiment of the present disclosure.
Figure 5:
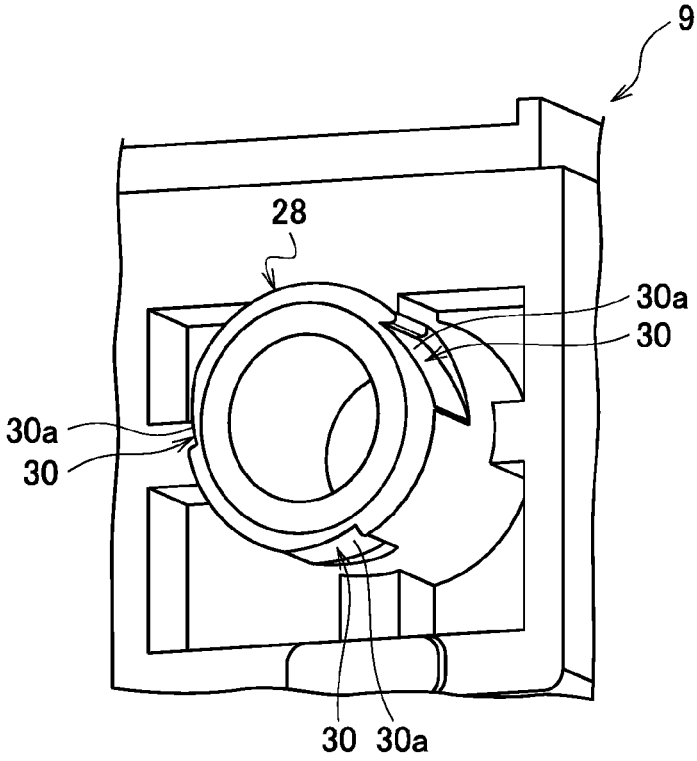
FIG. 5 is a right bottom perspective view showing the schematic configuration of the positioning boss of the LSU according to the embodiment of the present disclosure.
Figure 6:
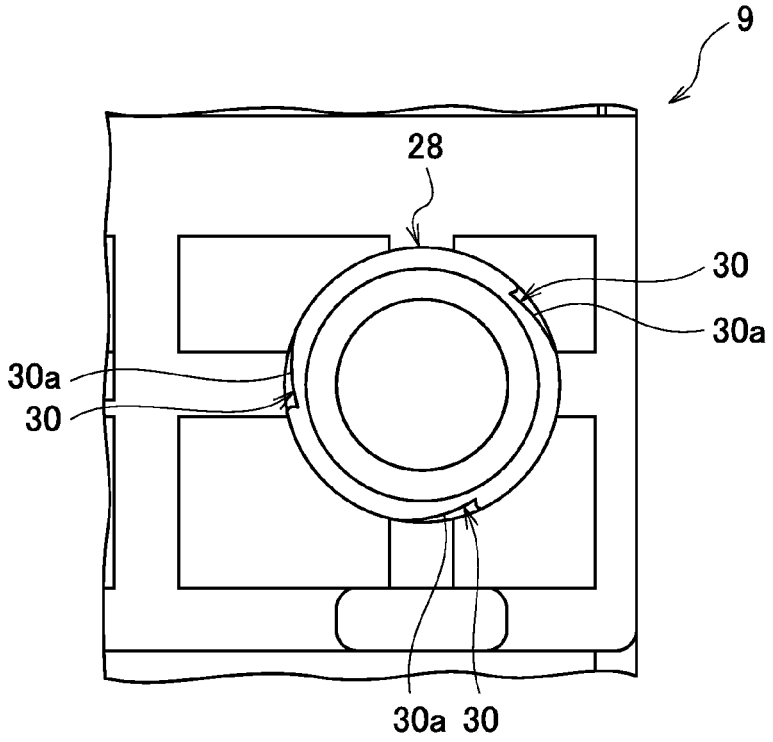
FIG. 6 is a front view showing the schematic configuration of the positioning boss of the LSU according to the embodiment of the present disclosure.
Figure 7:
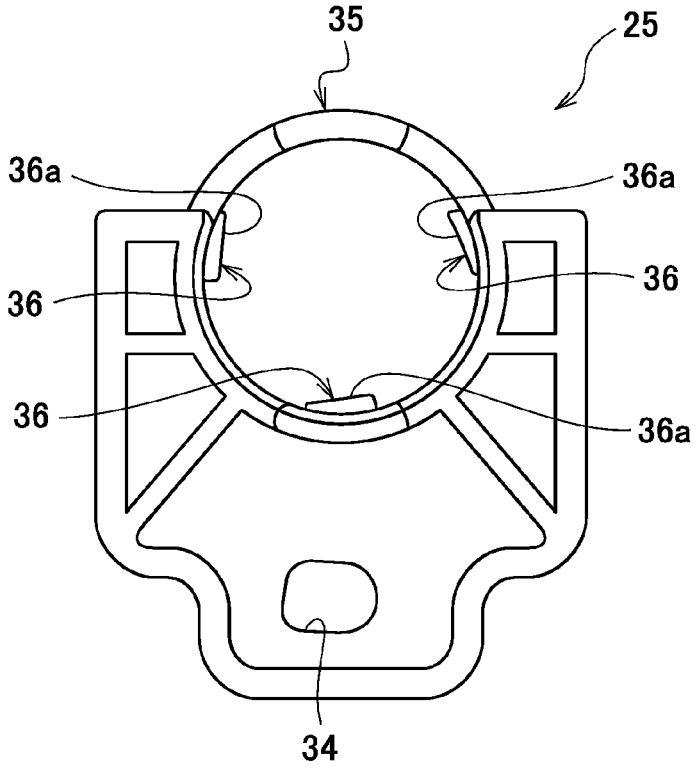
FIG. 7 is a front view showing the schematic configuration of a fixing member according to the embodiment of the present disclosure.

The fixing member 25 is formed, as shown in FIGS. 3 and 7, in a shape liked a plate which has a lower end cut out inward at both sides. In a lower part of the fixing member 25, a penetrating hole 34 capable of insertion of a screw 33 (refer to FIGS. 2 and 8B) is bored, while, in an upper part of the fixing member 25, a cylinder-liked annular part 35 is formed. An upper part of the annular part 35 is configured to protrude from an upper end of the fixing member 25, and, in a lower part of the annular part 35, a half cylinder-liked back extending part 35*a* (refer to FIG. 3) extending backward is formed. An outer circumference face of the back extending part 35*a* is configured in the dimensions capable of fitting to an internal circumference face of the opening 29. In addition, an internal circumference face of the annular part 35 is configured in the dimensions capable of fitting to an outer circumference face of the positioning boss 28.

On the internal circumference face of the annular part 35, projections 36 insertable in the depressions 30 of the positioning boss 28 are formed. In the embodiment, the projections 36 are arranged at three positions on the internal circumference face of the annular part 35 corresponding to the depressions 30 and the projections 36 are located at equal intervals in a circumferential direction. A top face 36*a* of the projection 36 slopes downward in the same direction as the bottom face 30*a* of the depression 30 (the clockwise direction) in the front view. That is, the height of the projection 36 gradually lowers in the clockwise direction in the front view of the annular part 35.

Next, a procedure for constructing the unit structure in such a configuration will be described. In the above-mentioned configuration, first, in a situation of inclining a front part of the LSU 9 upward, the other positioning bosses at the rear side of the LSU 9 are inserted in the openings of the rear side plate inside the frame 26. Subsequently, around the inserted parts as a fulcrum, the front part of the LSU 9 is turned downward so as to lay down the LSU 9, thereby inserting the positioning bosses 28 at the front side of the LSU 9 from above into the openings 29 of the front side plate 32 of the frame 26.

Figure 8B:
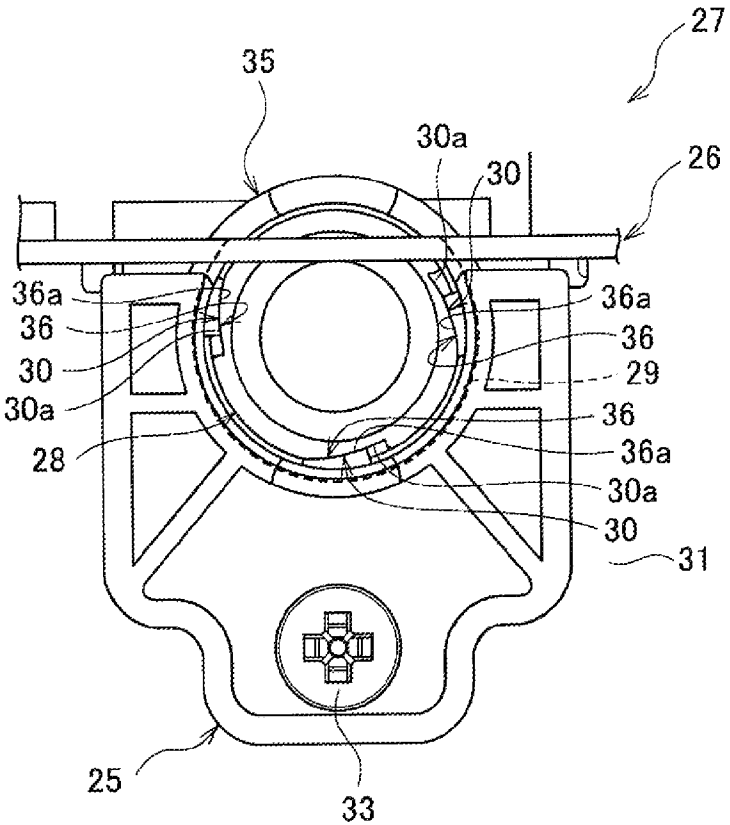
FIG. 8A is a front view showing the LSU and fixing member before positioning and fixing in the embodiment of the present disclosure and FIG. 8B is a front view showing the LSU and fixing member after positioning and fixing in the embodiment of the present disclosure.
Figure 8A:
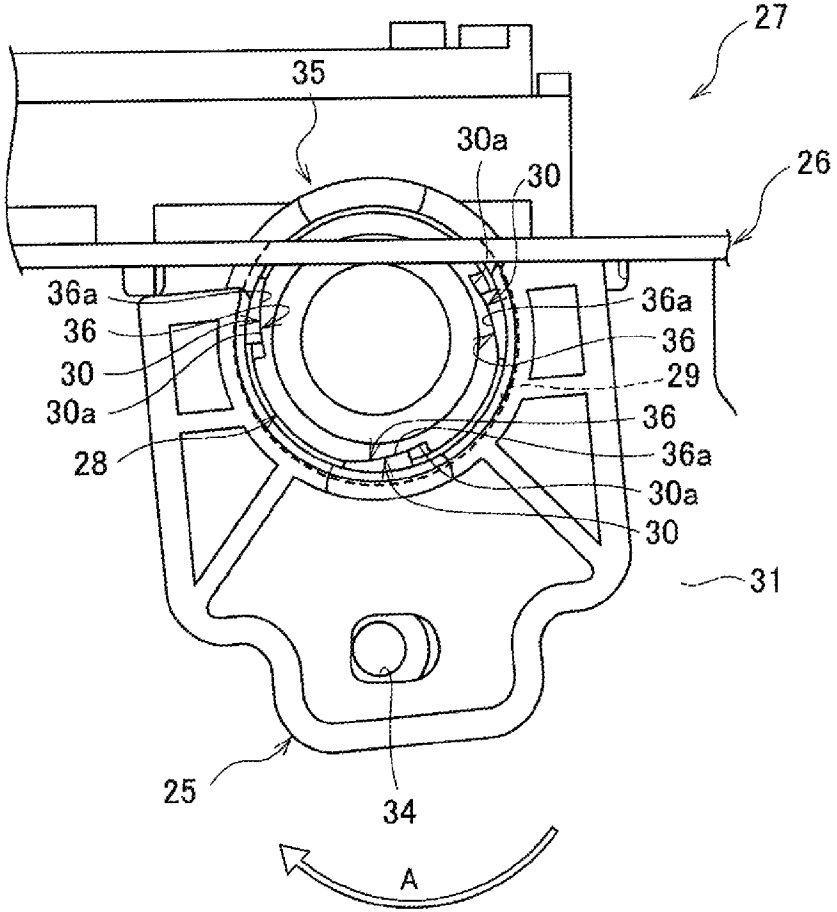
Figure 9:
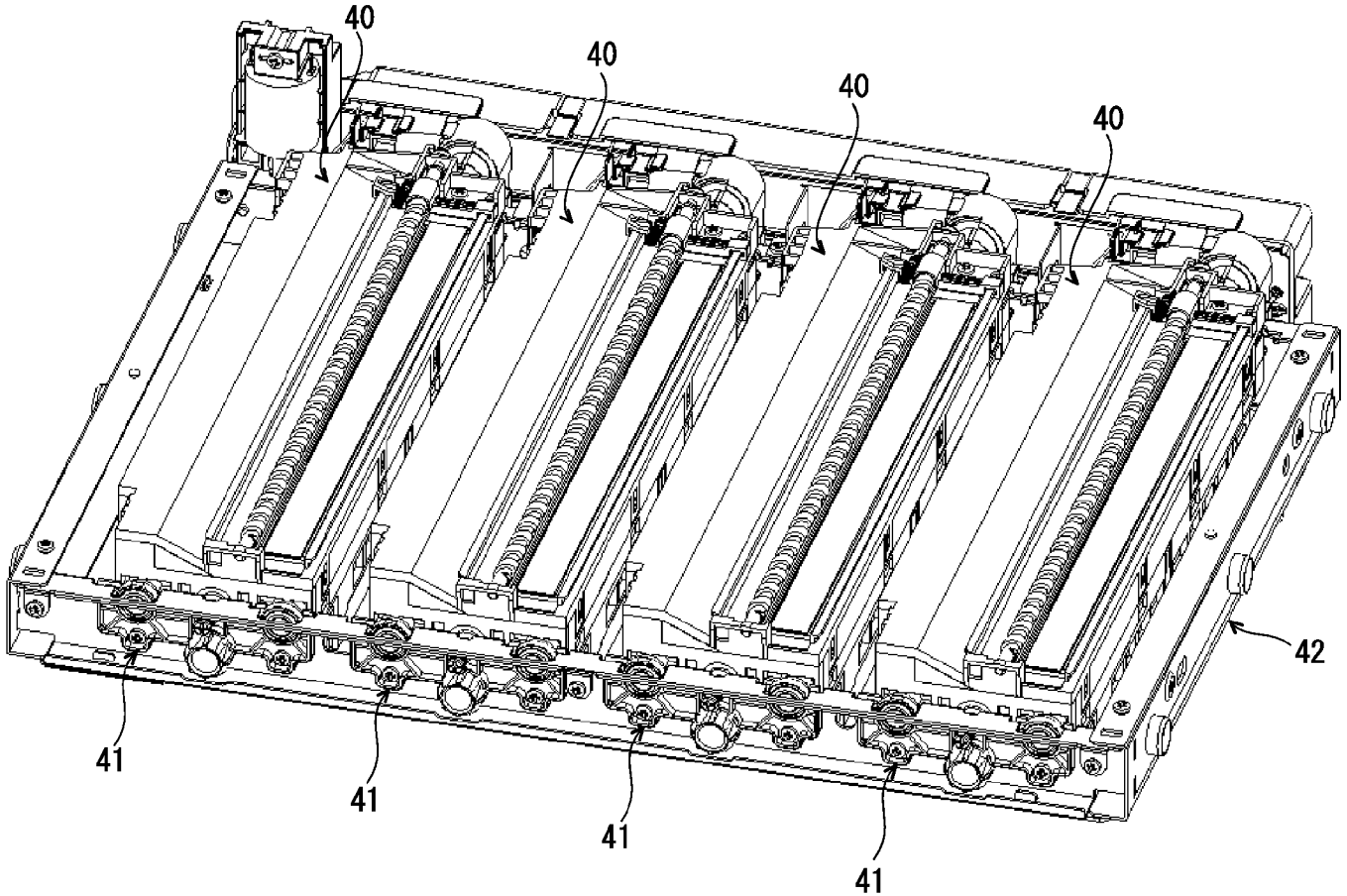
FIG. 9 is a front view showing a schematic configuration of a unit structure.
Figure 10:
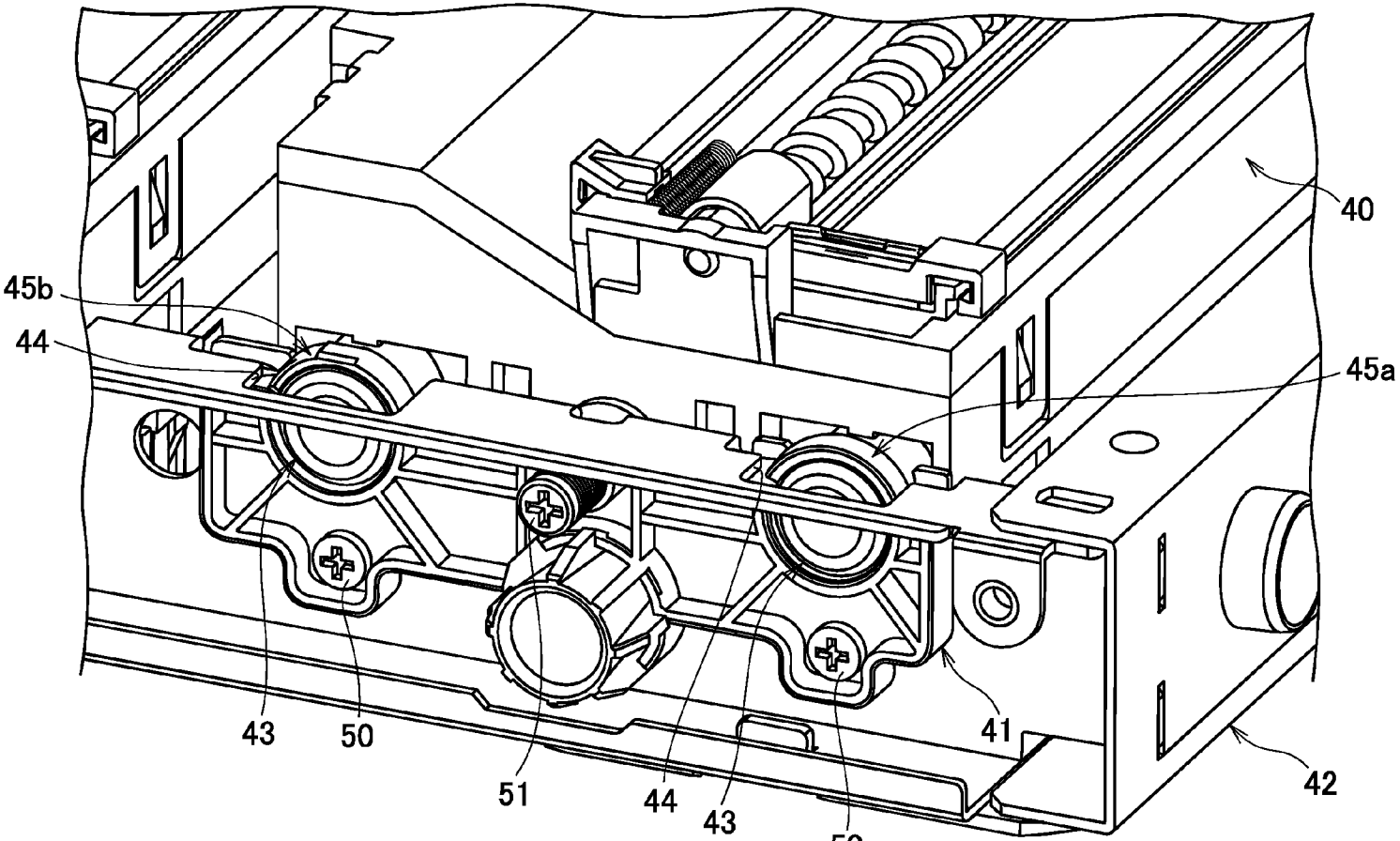
FIG. 10 is an enlarged front view showing the schematic configuration of the unit structure.
Figure 11:
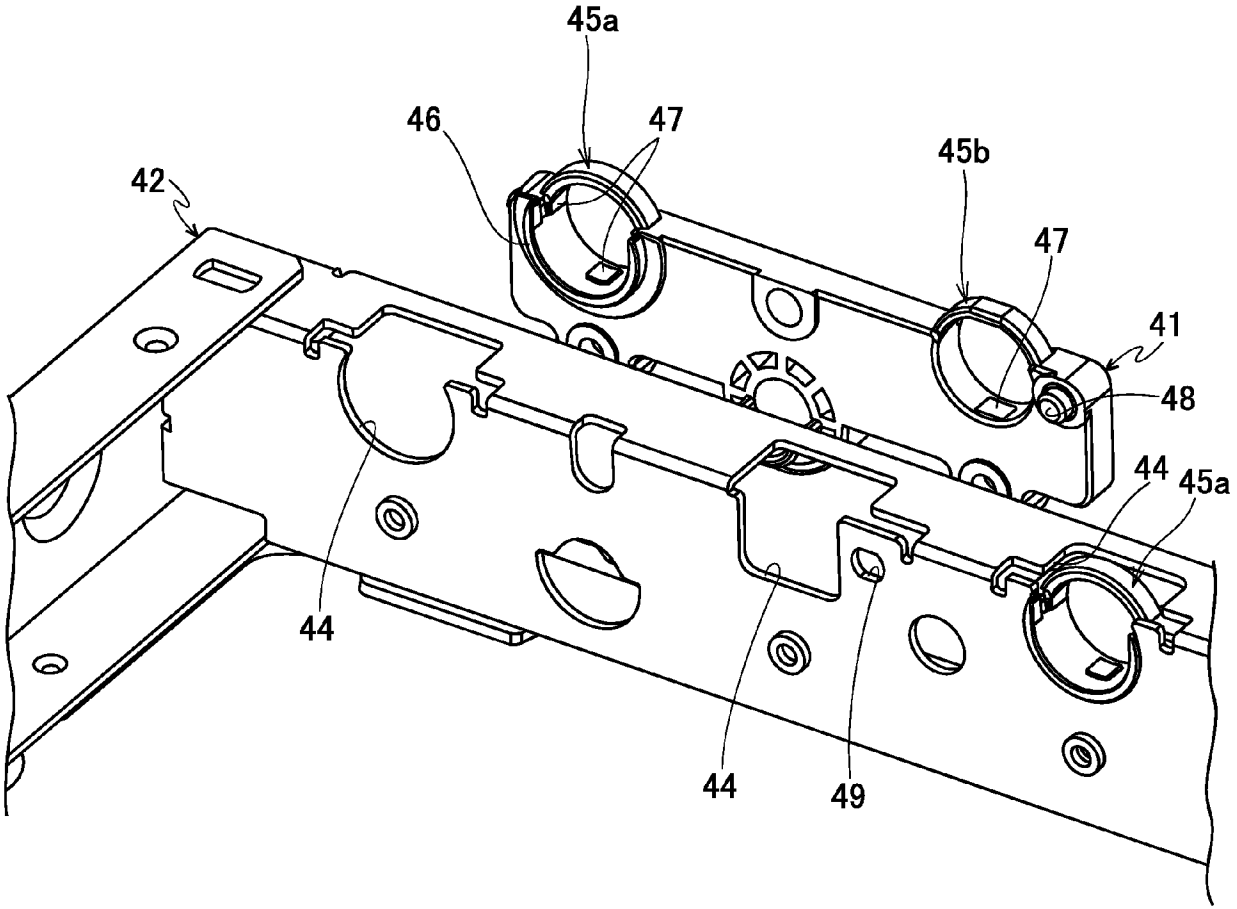
FIG. 11 is an enlarged back perspective view showing a fixing member before attaching to a frame.
Figure 12:
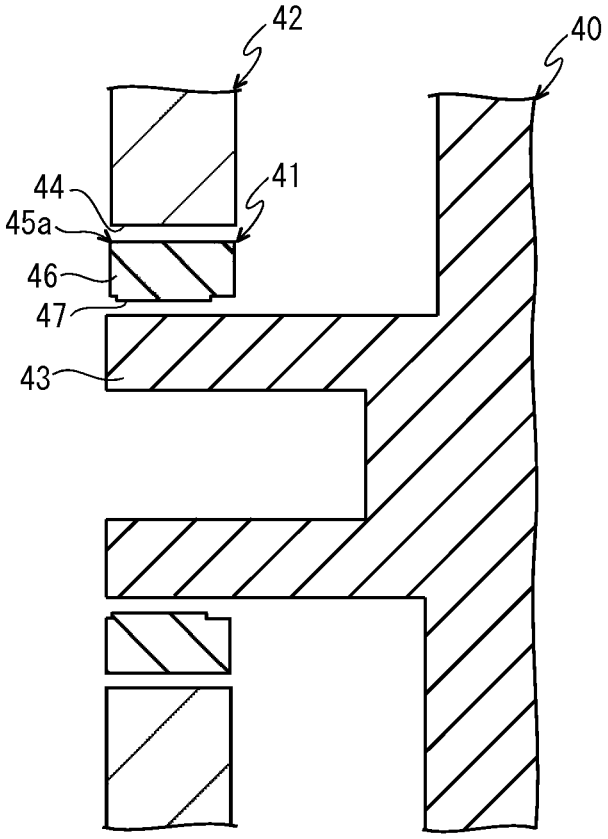
FIG. 12 is an enlarged horizontally sectional view showing the frame and an LSU after attaching to each other by the fixing member.

In such an inserting situation, faces of the fixing members 25 at the sides of the back extending parts 35*a* are faced against the frame 26 and the fixing members 25 are inclined in a counterclockwise direction around the annular parts 35 in the front view. In such postures of the fixing members 25, the annular parts 35 are put on the positioning bosses 28 insertionally so as to match each depression 30 with each projection 36. At that time, the outer circumference face of each positioning boss 28 guides the internal circumference face of each annular part 35. Thereby, as shown in FIG. 8A, the back extending part 35*a* of the annular part 35 is positioned between the outer circumference face of the positioning boss 28 and internal circumference face of the opening 29.

Subsequently, the annular part 35 is pushed further, and simultaneously, the fixing member 25 is turned in the clockwise direction in the front view (this turning direction is indicated by a reference character A). Accordingly, the outer circumference face of the back extending part 35*a* is fitted to the internal circumference face of the opening 29 and a gap between the top face 36*a* of the projection 36 and bottom face 30*a* of the depression 30 is closed. Thereby, the internal circumference face of the annular part 35 is fitted on the outer circumference face of the positioning boss 28. Thereafter, as shown in FIG. 8B, the screw 33 is inserted in the penetrating hole 34 and the screw 33 is screwed to a tapped hole 26*a* (refer to FIG. 8A) of the frame 26. Thereby, the LSU 9 is positioned and fixed to the frame 26 by the fixing member 25.

In the embodiment, both the top face 36*a* of the projection 36 and bottom face 30*a* of the depression 30 slope in the same direction on the respective circumferences in the front view. Accordingly, even if accuracy of the dimensions of the annular part 35 and positioning boss 28 become uneven, by turning the fixing member in a direction of narrowing a gap between the top face of the projection and bottom face of the depression, the top face of the projection is fastened to the bottom face of the depression. It is therefore possible to fit the annular part and positioning boss to each other without any gap. Thereby, it is possible to fix the optical scanner to the supporting structure with great accuracy of the positioning. As a result, without requiring any separate positioning part and positioning process, it is possible to restrain backlash in the construction, to increase the accuracy of the positioning of the LSU 9 to the frame 26 and to restrain an image error depending on the influence of oscillation. In addition, because a slidingly contact area of the top face 36*a* of the projection 36 and bottom face 30*a* of the depression 30 is increasing, it is possible to securely position and fix the LSU 9 to the frame 26.

On the internal circumference face of the annular part 35, the projections 36 are arranged at three positions at equal intervals in the circumferential direction and, on the outer circumference face of the positioning boss 28, the depressions 30 are arranged, according to the projections 36, at three positions at equal intervals in the circumferential direction. Therefore, because the positioning boss 28 can be positioned and fixed over the entire circumference, it is possible to more increase the accuracy of the positioning of the LSU 9 to the frame 26.

In the LSU 9, a pair of the positioning bosses 28 are arranged side by side and a pair of the fixing members 25 are respectively provided according to the positioning bosses 28. Therefore, because the positioning bosses 28 can be separately positioned, it is possible to furthermore increase the accuracy of the positioning of the LSU 9 to the frame 26.

The above-mentioned embodiment was described about a case where the projections 36 are formed on the internal circumference face of the annular part 35 and the depressions 30 are formed on the outer circumference face of the positioning boss 28. On the other hand, in another embodiment, the depressions 30 may be formed on the internal circumference face of the annular part 35 and the projections 36 may be formed on the outer circumference face of the positioning boss 28.

Moreover, the above-mentioned embodiment was described about a case where both the top face 36*a* of the projection 36 and bottom face 30*a* of the depression 30 slope in the same direction on the respective circumferences in the front view. On the other hand, in a further embodiment, any one of the top face 36*a* of the projection 36 and bottom face 30*a* of the depression 30 may slope to one side on the circumference in the front view.

Furthermore, the above-mentioned embodiment was described about a case where the top face 36*a* of the projection 36 slopes downward in the clockwise direction in the front view and the bottom face 30*a* of the depression 30 slopes upward in the clockwise direction in the front view. On the other hand, in a furthermore embodiment, the slope directions of the top face 36*a* of the projection 36 and bottom face 30*a* of the depression 30 may be the reverse of the above-mentioned case. At that time, the fixing member 25 may be turned in a counterclockwise direction in the front view. That is, the fixing member 25 may be turned in a direction of narrowing a gap between the top face 36*a* of the projection 36 and bottom face 30*a* of the depression 30.

In addition, the above-mentioned embodiment was described about a case where the projections 36 are arranged at three positions on the internal circumference face of the annular part 35 and the depressions 30 are arranged at three positions on the outer circumference face of the positioning boss 28. On the other hand, in still another embodiment, each of the projection 36 and depression 30 may be formed at one position. That is, it is preferable to provide one or more pairs of the projection 36 and depression 30.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An attachment mechanism of an optical scanner comprising:

a supporting structure in which an opening is formed; and a fixing member configured to position and fix the optical scanner in which a positioning boss held by the opening is formed and to include an annular part having an outer circumference face capable of fitting in the opening and an internal circumference face capable of fitting on the positioning boss, wherein one of the internal circumference face of the annular part and an outer circumference face of the positioning boss includes a projection and another includes a depression capable of insertion of the projection, at least one of a top face of the projection and a bottom face of the depression slopes to one side on the circumference of the annular part and positioning boss, and in a situation of inserting the positioning boss in the opening, by fitting the annular part in the opening and by turning the fixing member in a direction of narrowing a gap between the top face of the projection and bottom face of the depression, the optical scanner is fixed to the supporting structure.

2. The attachment mechanism of an optical scanner according to claim 1, wherein both the top face of the projection and bottom face of the depression slope in the same direction.

3. The attachment mechanism of an optical scanner according to claim 2, wherein the top face of the projection gradually lowers in a clockwise direction in a front view and the bottom face of the depression gradually shallows in the clockwise direction in the front view.

4. The attachment mechanism of an optical scanner according to claim 2, wherein the top face of the projection gradually lowers in a counterclockwise direction in a front view and the bottom face of the depression gradually shallows in the counterclockwise direction in the front view.

5. The attachment mechanism of an optical scanner according to claim 1, wherein on the internal circumference face of the annular part, a plurality of the projections are arranged in the circumferential direction and, on the outer circumference face of the positioning boss, a plurality of the depressions are arranged, according to the projections, in the circumferential direction.

6. The attachment mechanism of an optical scanner according to claim 1, wherein in the optical scanner, a plurality of the positioning bosses are arranged and a plurality of the fixing members are arranged according to the positioning bosses.

7. An image forming apparatus comprising:

an attachment mechanism of an optical scanner configured to include:

a supporting structure in which an opening is formed; and a fixing member configured to position and fix the optical scanner in which a positioning boss held by the opening is formed and to include an annular part having an outer circumference face capable of fitting in the opening and an internal circumference face capable of fitting on the positioning boss, wherein one of the internal circumference face of the annular part and an outer circumference face of the positioning boss includes a projection and another includes a depression capable of insertion of the projection, at least one of a top face of the projection and a bottom face of the depression slopes to one side on the circumference of the annular part and positioning boss, in a situation of inserting the positioning boss in the opening, by fitting the annular part in the opening and by turning the fixing member in a direction of narrowing a gap between the top face of the projection and bottom face of the depression, the optical scanner is fixed to the supporting structure.

8. The image forming apparatus according to claim 7, wherein both the top face of the projection and bottom face of the depression slope in the same direction.

9. The image forming apparatus according to claim 8, wherein the top face of the projection gradually lowers in a clockwise direction in a front view and the bottom face of the depression gradually shallows in the clockwise direction in the front view.

10. The image forming apparatus according to claim 8, wherein the top face of the projection gradually lowers in a counterclockwise direction in a front view and the bottom face of the depression gradually shallows in the counterclockwise direction in the front view.

11. The image forming apparatus according to claim 7, wherein on the internal circumference face of the annular part, a plurality of the projections are arranged in the circumferential direction and, on the outer circumference face of the positioning boss, a plurality of the depressions are arranged, according to the projections, in the circumferential direction.

12. The image forming apparatus according to claim 7, wherein in the optical scanner, a plurality of the positioning bosses are arranged and a plurality of the fixing members are arranged according to the positioning bosses.

* * * * *

UNITED STATES PATENT AND TRADEMARK OFFICE

CERTIFICATE OF CORRECTION

PATENT NO. : 8,760,484 B2
APPLICATION NO. : 13/899390
DATED : June 24, 2014
INVENTOR(S) : Masato Ohnishi It is certified that error appears in the above-identified patent and that said Letters Patent is hereby corrected as shown below:

On the title page item (73), should read:

Assignee: KYOCERA Document Solutions Inc., Osaka (JP);

Signed and Sealed this
Twenty-fourth Day of February, 2015

Michelle K. Lee

Michelle K. Lee
*Deputy Director of the United States Patent and Trademark Office*